US009133697B2

(12) United States Patent
Cavender et al.

(10) Patent No.: US 9,133,697 B2
(45) Date of Patent: Sep. 15, 2015

(54) PRODUCING RESOURCES USING HEATED FLUID INJECTION

(75) Inventors: Travis W. Cavender, Angleton, TX (US); Roger L. Schultz, Aubrey, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 1289 days.

(21) Appl. No.: 12/667,988

(22) PCT Filed: Jun. 30, 2008

(86) PCT No.: PCT/US2008/068816

§ 371 (c)(1), (2), (4) Date: Nov. 3, 2010

(87) PCT Pub. No.: WO2009/009336

PCT Pub. Date: Jan. 15, 2009

(65) Prior Publication Data

US 2011/0036575 A1 Feb. 17, 2011

Related U.S. Application Data

(60) Provisional application No. 60/948,346, filed on Jul. 6, 2007.

(51) Int. Cl.
*E21B 36/02* (2006.01)
*E21B 43/24* (2006.01)
(Continued)

(52) U.S. Cl.
CPC ..... *E21B 43/24* (2013.01); *E21B 36/02* (2013.01); *E21B 41/0042* (2013.01); *E21B 43/305* (2013.01)

(58) Field of Classification Search
CPC ..... E21B 36/00; E21B 36/008; E21B 36/02; E21B 43/24; E21B 41/0042
USPC ..... 166/302, 373, 381, 57, 59, 60, 316, 166/332.1, 334.1, 65.1
See application file for complete search history.

(56) References Cited

U.S. PATENT DOCUMENTS 3,410,347 A * 11/1968 Triplett et al. ..... 166/59
3,547,192 A 12/1970 Claridge et al.
(Continued)

FOREIGN PATENT DOCUMENTS

EP 0 072 676 2/1983
EP 0 088 376 A2 9/1983
(Continued)

OTHER PUBLICATIONS

Translation of Office Action dated Aug. 10, 2010 for corresponding Russian patent application No. 2010102671/03(003662).
(Continued)

*Primary Examiner* — Elizabeth Gitlin
(74) *Attorney, Agent, or Firm* — Scott Richardson; Fish & Richardson P.C.

(57) ABSTRACT

A system for treating a subterranean zone (110) includes a downhole fluid heater (120) installed in a wellbore (114). Treatment fluid, oxidant, and fuel conduits (124*a*, 124*b*, and 124*c*) connect fuel, oxidant and treatment fluid sources (142*a*, 142*b*and 142*c*) to the downhole fluid heater (120). A downhole fuel control valve (126*c*) is in communication with the fuel conduit (124*c*) and is configured to change flow to the downhole fluid heater (120) in response to a change of pressure in a portion of the wellbore.

20 Claims, 4 Drawing Sheets

(51) Int. Cl.
*E21B 41/00* (2006.01)
*E21B 43/30* (2006.01)

(56) References Cited

U.S. PATENT DOCUMENTS

| | | | | |
|---|---|---|---|---|
| 3,946,809 | A | 3/1976 | Hagedorn | |
| 3,980,137 | A | 9/1976 | Gray | |
| 3,982,591 | A | 9/1976 | Hamrick et al. | |
| 4,008,765 | A | 2/1977 | Anderson et al. | |
| 4,019,575 | A | 4/1977 | Pisio et al. | |
| 4,019,578 | A | 4/1977 | Terry et al. | |
| 4,020,901 | A | 5/1977 | Pisio et al. | |
| 4,022,275 | A | 5/1977 | Brandon | |
| 4,022,280 | A | 5/1977 | Stoddard et al. | |
| 4,033,411 | A | 7/1977 | Goins | |
| 4,037,655 | A | 7/1977 | Carpenter | |
| 4,049,053 | A | 9/1977 | Fisher et al. | |
| 4,053,015 | A * | 10/1977 | Hamrick et al. | 166/302 |
| 4,066,127 | A | 1/1978 | Harnsberger | |
| 4,067,391 | A | 1/1978 | Dewell | |
| 4,068,715 | A | 1/1978 | Wu | |
| 4,077,469 | A | 3/1978 | Hamrick et al. | |
| 4,088,188 | A | 5/1978 | Widmyer | |
| 4,114,687 | A | 9/1978 | Payton | |
| 4,114,691 | A | 9/1978 | Payton | |
| 4,120,357 | A | 10/1978 | Anderson | |
| 4,137,968 | A | 2/1979 | Howard et al. | |
| 4,199,024 | A | 4/1980 | Hamrick et al. | |
| 4,262,745 | A | 4/1981 | Stewart | |
| 4,274,487 | A | 6/1981 | Hollingsworth et al. | |
| 4,385,661 | A | 5/1983 | Fox | |
| 4,390,062 | A | 6/1983 | Fox | |
| 4,411,618 | A | 10/1983 | Donaldson et al. | |
| 4,429,748 | A | 2/1984 | Beck | |
| 4,442,898 | A * | 4/1984 | Wyatt | 166/59 |
| 4,453,597 | A | 6/1984 | Brown et al. | |
| 4,456,068 | A | 6/1984 | Burrill, Jr. et al. | |
| 4,460,044 | A | 7/1984 | Porter | |
| 4,475,596 | A | 10/1984 | Papst | |
| 4,485,868 | A | 12/1984 | Sresty et al. | |
| 4,499,946 | A | 2/1985 | Martin et al. | |
| 4,532,994 | A | 8/1985 | Toma et al. | |
| 4,565,245 | A | 1/1986 | Mims et al. | |
| 4,595,057 | A | 6/1986 | Deming et al. | |
| 4,620,593 | A | 11/1986 | Haagensen | |
| 4,640,359 | A | 2/1987 | Livesey et al. | |
| 4,641,710 | A | 2/1987 | Klinger | |
| 4,648,835 | A | 3/1987 | Eisenhawer et al. | |
| 4,694,907 | A | 9/1987 | Stahl et al. | |
| 4,697,642 | A | 10/1987 | Vogel | |
| 4,706,751 | A | 11/1987 | Gondouin | |
| 4,726,759 | A | 2/1988 | Wegener | |
| 4,834,174 | A | 5/1989 | Vandevier | |
| 4,861,263 | A | 8/1989 | Schirmer | |
| 4,895,206 | A * | 1/1990 | Price | 166/260 |
| 4,930,454 | A | 6/1990 | Latty et al. | |
| 4,945,984 | A | 8/1990 | Price | |
| 4,983,364 | A | 1/1991 | Buck et al. | |
| 5,052,482 | A | 10/1991 | Gondouin | |
| 5,055,030 | A | 10/1991 | Schirmer | |
| 5,282,508 | A | 2/1994 | Ellingsen et al. | |
| 5,358,054 | A | 10/1994 | Bert | |
| 5,452,763 | A * | 9/1995 | Owen | 166/259 |
| 5,520,252 | A | 5/1996 | McNair | |
| 5,713,415 | A | 2/1998 | Bridges | |
| 5,803,178 | A | 9/1998 | Cain | |
| 6,079,494 | A | 6/2000 | Longbottom et al. | |
| 6,098,516 | A * | 8/2000 | Gazonas | 86/20.15 |
| 6,353,706 | B1 | 3/2002 | Bridges | |
| 6,454,010 | B1 | 9/2002 | Thomas et al. | |
| 6,588,500 | B2 | 7/2003 | Lewis | |
| 6,681,859 | B2 | 1/2004 | Hill | |
| 6,752,210 | B2 | 6/2004 | de Rouffignac et al. | |
| 6,755,246 | B2 | 6/2004 | Chen et al. | |
| 6,769,483 | B2 | 8/2004 | de Rouffignac et al. | |
| 6,789,625 | B2 | 9/2004 | de Rouffignac et al. | |
| 6,902,004 | B2 | 6/2005 | de Rouffignac et al. | |
| 7,096,953 | B2 | 8/2006 | de Rouffignac et al. | |
| 2002/0112857 | A1 | 8/2002 | Ohmer et al. | |
| 2002/0148608 | A1 | 10/2002 | Shaw | |
| 2003/0102123 | A1 | 6/2003 | Wittle et al. | |
| 2003/0102124 | A1 | 6/2003 | Vinegar et al. | |
| 2003/0111223 | A1 | 6/2003 | Rouffignac et al. | |
| 2003/0116315 | A1 | 6/2003 | Wellington et al. | |
| 2003/0127226 | A1 | 7/2003 | Heins | |
| 2003/0131993 | A1 | 7/2003 | Zhang et al. | |
| 2003/0131994 | A1 | 7/2003 | Vinegar et al. | |
| 2003/0141065 | A1 | 7/2003 | Karanikas et al. | |
| 2003/0141066 | A1 | 7/2003 | Karanikas et al. | |
| 2003/0141067 | A1 | 7/2003 | Rouffignac et al. | |
| 2003/0141068 | A1 | 7/2003 | Pierre de Rouffignac et al. | |
| 2003/0164239 | A1 | 9/2003 | Wellington et al. | |
| 2003/0173086 | A1 | 9/2003 | Howard et al. | |
| 2003/0183390 | A1 | 10/2003 | Veenstra et al. | |
| 2003/0221843 | A1 | 12/2003 | Fipke et al. | |
| 2004/0055750 | A1 | 3/2004 | Restarick et al. | |
| 2004/0154793 | A1 | 8/2004 | Zapadinski | |
| 2004/0177966 | A1 | 9/2004 | Vinegar et al. | |
| 2004/0211554 | A1 | 10/2004 | Vinegar et al. | |
| 2004/0211569 | A1 | 10/2004 | Vinegar et al. | |
| 2004/0261729 | A1 | 12/2004 | Sarkar | |
| 2005/0006097 | A1 | 1/2005 | Sandberg et al. | |
| 2005/0103497 | A1 | 5/2005 | Gondouin | |

FOREIGN PATENT DOCUMENTS

| | | | |
|---|---|---|---|
| EP | 0 072 676 | B1 | 4/1987 |
| EP | 0 387 846 | A1 | 9/1990 |
| EP | 0 747 142 | A1 | 12/1996 |
| EP | 0 900 911 | | 3/1999 |
| GB | 2 241 008 | | 8/1991 |
| GB | 2 286 001 | | 8/1995 |
| GB | 2 408 761 | | 6/2005 |
| WO | WO 98/40603 | A2 | 9/1998 |
| WO | WO 2004/050567 | A1 | 6/2004 |

OTHER PUBLICATIONS

K.C. Hong, "Recent Advances in Steamflood Technology," SPE 54078, Copyright 1999, Society of Petroleum Engineers, Inc., 14 pages.

Gary R. Greaser and J. Raul Ortiz, "New Thermal Recovery Technology and Technology Transfer for Successful Heavy Oil Development," SPE 69731, Copyright 2003, Society of Petroleum Engineers, Inc., 7 pages.

A.J. Mulac, J.A. Beyeloer, R.G. Clay, K.R. Darnall, A.B. Donaldson, T.D. Donham, R.L. Fox, D.R. Johnson and R.L. Maxwell, "Project Deep Steam Preliminary Field Test Bakersfield, California," SAND80-2843, Printed Apr. 1981, 62 pages.

NTIS, Downhole Steam-Generator Study. vol. 1, Conception and Feasibility Evaluation. Final Report, Sep. 1978-Sep. 1980, Sandia National Labs, Albuquerque NM, Jun. 1982. 260 pages.

Presentation by Daulat D. Mamora, "Thermal Oil Recovery Research at Texas A&M in the Past Five Years-an Overview," Crisman Institute Halliburton Center for Unconventional Resources, Research Meeting Aug. 3, 2006, Department of Petroleum Engineering, Texas A&M University (13 pages).

Presentation by Jose A. Rivero, "An Experimental Study of Steam and Steam-Propane Injection Using a Novel Smart Horizontal Producer to Enhance Oil Production in the San Ardo Field." Sponsor's Meeting, Crisman Institute, Aug. 3, 2006, Department of Petroleum Engineering, Texas A&M University, 7 pages.

Presentation by Namit J. Jaiswal, "*Experimental and Analytical Studies of Hydrearbon Yields Under Dry-, Steam-, and Steam with Propane-Distillation*," Crisman Institute's Halliburton Center for Unconventional Resources, Aug. 3, 2006, Department of Petroleum Engineering, Texas A&M University, 5 pages.

Examination Report for European Patent Application No. 08781189.9 dated Jun. 1, 2010, 4 pages.

Office Action dated Jul. 15, 2011 for corresponding Canadian patent application No. 2,692,686 (2 pages).

(56) References Cited

OTHER PUBLICATIONS

Office Action mailed Apr. 20, 2012 in corresponding Chinese patent application No. 200880023608.9 (11 pages).
Office Action mailed May 8, 2012 in corresponding Canadian patent application No. 2,692,686 (2 pages).
Authorized officer Lili Xuan, The Third Office Action in Chinese Application No. 20880023608.9, mailed May 9, 2013, 5 pages.
Authorized officer Lili Xuan, The Second Office Action in Chinese patent application No. 200880023608.9, mailed Dec. 24, 2012, 10 pages.

* cited by examiner

PRODUCING RESOURCES USING HEATED FLUID INJECTION

REFERENCE TO RELATED APPLICATIONS

This application is a National Stage application of, and claims the benefit of priority to, PCT/US2008/068816, filed Jun. 30, 2008, which claims the benefit of priority to U.S. Provisional Patent Application No. 60/948,346 filed Jul. 6, 2007, the entirety of both are incorporated by reference herein.

TECHNICAL FIELD

This invention relates to resource production, and more particularly to resource production using heated fluid injection into a subterranean zone.

BACKGROUND

Fluids in hydrocarbon formations may be accessed via wellbores that extend down into the ground toward the targeted formations. In some cases, fluids in the hydrocarbon formations may have a low enough viscosity that crude oil flows from the formation, through production tubing, and toward the production equipment at the ground surface. Some hydrocarbon formations comprise fluids having a higher viscosity, which may not freely flow from the formation and through the production tubing. These high viscosity fluids in the hydrocarbon formations are occasionally referred to as "heavy oil deposits." In the past, the high viscosity fluids in the hydrocarbon formations remained untapped due to an inability to economically recover them. More recently, as the demand for crude oil has increased, commercial operations have expanded to the recovery of such heavy oil deposits.

In some circumstances, the application of heated treatment fluids (e.g., steam and/or solvents) to the hydrocarbon formation may reduce the viscosity of the fluids in the formation so as to permit the extraction of crude oil and other liquids from the formation. The design of systems to deliver the steam to the hydrocarbon formations may be affected by a number of factors.

SUMMARY

Systems and methods of producing fluids from a subterranean zone can include downhole fluid heaters (including steam generators) alone or in conjunction with artificial lift systems such as pumps (e.g., electric submersible, progressive cavity, and others), gas lift systems, and other devices. Supplying heated fluid from the downhole fluid heater(s) to a target subterranean zone such as a hydrocarbon-bearing formation or cavity can reduce the viscosity of oil and/or other fluids in the target formation.

Configuring systems such that loss of surface, wellbore, or supply (e.g., treatment fluid supply) pressure causes control valves in downhole fluid heater supply lines (e.g., treatment fluid, fuel, and/or oxidant lines) to close can reduce the possibility that downhole combustion will continue after a system failure. Control valves that are disposed downhole (rather than at the surface) can reduce the amount of fluids (e.g., treatment fluid, fuel, and/or oxidant) that flows out of the supply lines. In some instances, the control valves can be passive control valves biased towards a closed position and opened by application of specified pressure. Pressure changes due to, for example, failure of a well casing can cause the valve to close without relying signals from the surface. In some instances, hydraulically or electrically operated valves can be operated by local (e.g., downhole) or remote (e.g., surface) control systems in response to readings from downhole pressure sensors.

In one aspect, systems include: a downhole fluid heater having a treatment fluid inlet, an oxidant inlet and a fuel inlet; and a downhole control valve in communication with one of the treatment fluid inlet, oxidant inlet or fuel inlet of the downhole fluid heater, the downhole control valve responsive to change flow to the inlet based at least on pressure in the wellbore.

Such systems can include one or more of the following features.

In some embodiments, systems also include a seal disposed between the downhole fluid heater and the control valve, the seal adapted to contact a wall of the wellbore and hydraulically isolate a portion of the wellbore above the seal from a portion of the wellbore below the seal. In some cases, systems also include a second seal opposite the control valve from the first mentioned seal, the second seal adapted to contact the wall of the wellbore and hydraulically isolate a portion of the wellbore above the second seal from a portion of the wellbore below the second seal; and a conduit in communication with a space between the first mentioned seal and the second mentioned seal and adapted to provide pressure to the wellbore between the first mentioned seal and the second mentioned seal. The conduit can be in communication with a treatment fluid supply adapted to provide treatment fluid to the downhole fluid heater.

In some embodiments, the downhole control valve further comprises a moveable member movable to change the flow to the inlet at least in part by a pressure differential between the flow to the inlet and pressure in the wellbore.

In some embodiments, the downhole control valve is in communication with the fuel inlet; and the system also includes a second downhole control valve in communication with one of the treatment fluid inlet or oxidant inlet of the downhole fluid heater.

In some embodiments, the downhole control valve is in communication with one of the oxidant inlet or fuel inlet of the downhole fluid heater, and the downhole control valve is responsive to change the fuel and oxidant ratio based at least on pressure in the wellbore.

In some embodiments, the downhole control valve is proximate the downhole fluid heater.

In some embodiments, the control valve is a control valve responsive to cease flow to the inlet based on a loss of pressure in the wellbore.

In some embodiments, the downhole fluid heater comprises a downhole steam generator.

In one aspect, systems include: a downhole fluid heater installed in a wellbore; treatment fluid, oxidant, and fuel conduits connecting fuel, oxidant and treatment fluid sources to the downhole fluid heater; and a downhole fuel control valve in communication with the fuel conduit configured to change flow to the downhole fluid heater in response to a changes of pressure in a portion of the wellbore.

Such systems can include one or more of the following features.

In some embodiments, systems also include a seal disposed between the downhole fluid heater and the fuel shutoff valve, the seal sealing against axial flow in the wellbore, and wherein the downhole fuel control valve is configured to change flow to the downhole fluid heater in response to a loss of pressure above the seal. In some cases, systems also include a second seal disposed uphole of the fuel shutoff valve, the second seal sealing against axial flow in the wellbore, and wherein the treatment fluid conduit is hydraulically connected to a portion of the wellbore defined in part between the first mentioned seal and the second seal.

In some embodiments, the downhole fuel shutoff valve comprises a moveable member movable at least in part by pressure in the wellbore to change flow through the fuel conduit.

In some embodiments, systems also include a second downhole control valve in communication with the treatment fluid or the oxidant conduit and responsive to pressure in the portion of the wellbore.

In some embodiments, the downhole fluid heater comprises a downhole steam generator.

In one aspect, methods include: receiving, at downhole fluid heater in a wellbore, flows of treatment fluid, oxidant, and fuel; and with a downhole valve responsive to wellbore annulus pressure, changing the flow of at least one of the treatment fluid, oxidant or fuel.

Such methods can include one or more of the following features.

In some embodiments, changing the flow comprises changing the flow in response to a loss of pressure in the wellbore annulus. In some cases, changing the flow comprises ceasing the flow.

In some embodiments, methods also include applying pressure to a portion of the wellbore proximate the downhole valve, and wherein changing the flow comprises changing the flow in response to a loss of pressure in the wellbore proximate the downhole valve.

In some embodiments, changing the flow comprises changing the flow of at least one of the oxidant or the fuel to change a ratio of oxidant to fuel supplied to the downhole fluid heater.

In some cases, the downhole fluid heater comprises a downhole steam generator.

Systems and methods based on downhole fluid heating can improve the efficiencies of heavy oil recovery relative to conventional, surface based, fluid heating by reducing the energy or heat loss during transit of the heated fluid to the target subterranean zones. Some instances, this can reduce the fuel consumption required for heated fluid generation.

In some instances, downhole fluid heater systems (e.g., steam generator systems) include automatic control valves in the proximity of the downhole fluid heater for controlling the flow rate of water, fuel and oxidant to the downhole fluid heater. These systems can be configured such that loss of surface, wellbore or supply pressure integrity will cause closure of the downhole safety valves and rapidly discontinue the flow of fuel, treatment fluid, and/or oxidant to the downhole fluid heater to provide failsafe downhole combustion or other power release.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Systems and methods of treating a subterranean zone can include use of downhole fluid heaters to apply heated treatment fluid to the subterranean zone. One type of downhole fluid heater is a downhole steam generator that generates heated steam or steam and heated liquid. Although "steam" typically refers to vaporized water, a downhole steam generator can operate to heat and/or vaporize other liquids in addition to, or as an alternative to, water. Supplying heated treatment fluid from the downhole fluid heater(s) to a target subterranean zone, such as one or more hydrocarbon-bearing formations or a portion or portions thereof, can reduce the viscosity of oil and/or other fluids in the target subterranean zone. In some instances, downhole fluid heater systems include automatic control valves in the proximity of the downhole fluid heater for controlling the flow rate of water, fuel and oxidant to the downhole fluid heater. These systems can be configured such that loss of surface, wellbore or supply pressure integrity will cause closure of the downhole safety valves and rapidly discontinue the flow of fuel, water, and/or oxidant to the downhole fluid heater to provide failsafe downhole combustion or other power release.

Figure 1:
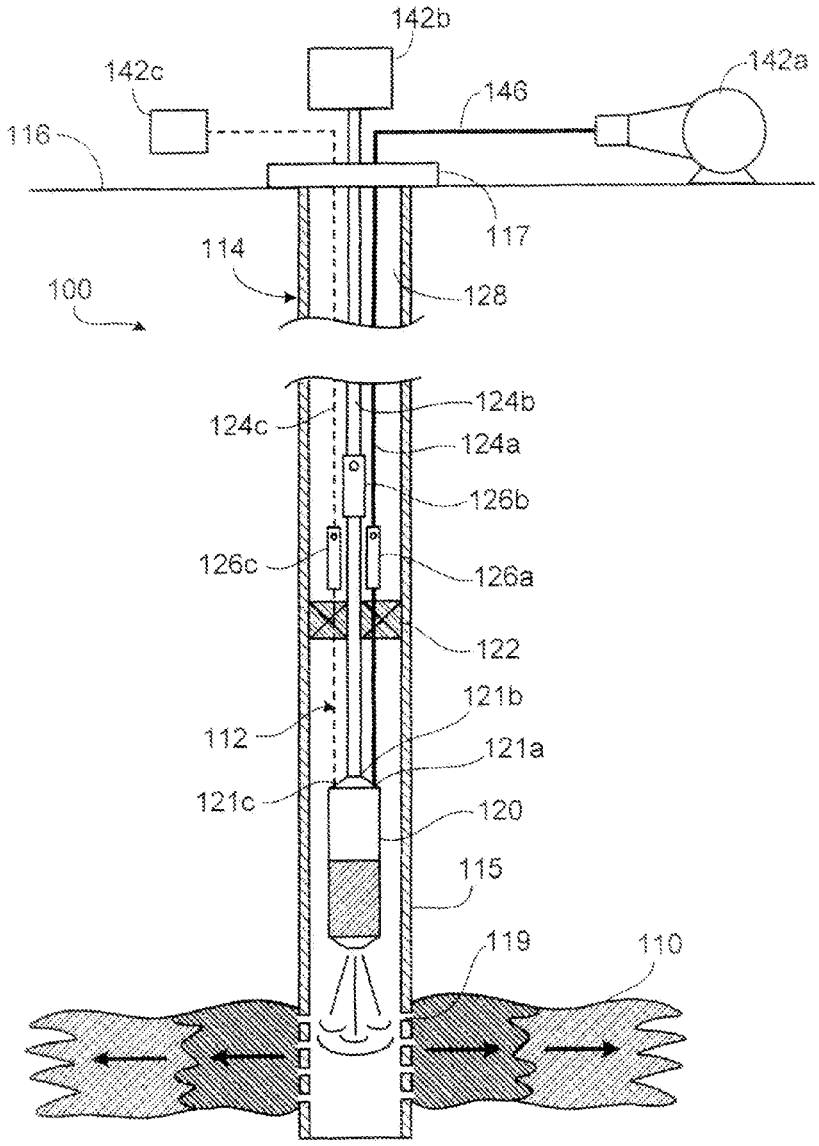
FIG. 1 is a schematic view of an embodiment of a system for treating a subterranean zone.

Referring to FIG. 1, a system 100 for treating a subterranean zone 110 includes a treatment injection string 112 disposed in a wellbore 114. The treatment injection string 112 is adapted to communicate fluids from a terranean surface 116 to the subterranean zone 110. A downhole fluid heater 120, operable to heat, in some cases to the point of complete and/or partial vaporization, a treatment fluid in the wellbore 114, is also disposed in the wellbore 114 as part of the treatment injection string 112. As used herein, "downhole" devices are devices that are adapted to be located and operate in a wellbore.

Supply lines 124*a*, 124*b*, and 124*c* carry fluids from the surface 116 to corresponding inlets 121*a*, 121*b*, 121*c* of the downhole fluid heater 120. For example, in some embodiments, the supply lines 124*a*, 124*b*, and 124*c* are a treatment fluid supply line 124*a*, an oxidant supply line 124*b*, and a fuel supply line 124*c*. In some embodiments, the treatment fluid supply line 124*a* is used to carry water to the downhole fluid heater 120. The treatment fluid supply line 124*a* can be used to carry other fluids (e.g., synthetic chemical solvents or other treatment fluid) instead of or in addition to water. In this embodiment, fuel, oxidant, and water are pumped at high pressure from the surface to the downhole fluid heater 120.

Each supply line 124*a*, 124*b*, 124*c* has a downhole control valve 126*a*, 126*b*, 126*c*. In some situations (e.g., if the casing system in the well fails), it is desirable to rapidly discontinue the flow of fuel, oxidant and/or treatment fluid to the downhole fluid heater 120. A valve in the supply lines 124*a*, 124*b*, 124*c* deep in the well, for example in the proximity of the fluid heater, can prevent residual fuel and/or oxidant in the supply lines 124*a*, 124*b*, 124*c* from flowing to the fluid heater, preventing further combustion/heat generation, and can limit (e.g., prevent) discharge of the reactants in the downhole supply lines 124*a*, 124*b*, 124*c* into the wellbore. The downhole control valves 126*a*, 126*b*, 126*c* are configured to control and/or shut off flow through the supply lines 124*a*, 124*b*, 124*c*, respectively, in specified circumstances. Although three downhole control valves 126*a*, 126*b*, 126*c* are depicted, fewer or more control valves could be provided.

A seal 122 (e.g., a packer) is disposed between the downhole fluid heater 120 and control valves 126*a*, 126*b*, 126*c*. The seal 122 may be carried by treatment injection string 112. The seal 122 may be selectively actuable to substantially seal and/or seal against the wall of the wellbore 114 to seal and/or substantially seal the annulus between the wellbore 114 and the treatment injection string 112 and hydraulically isolate a portion of the wellbore 114 uphole of the seal 122 from a portion of the wellbore 114 downhole of the seal 122.

In this embodiment, treatment control valve 126*a*, fuel control valve 126*c* and oxidant control valve 126*b* are deployed at the bottom of the delivery supply lines just above the packer 122. The control valves 126*a*, 126*b*, 126*c* will close unless a minimum pressure is maintained on the wellbore annulus above the packer 122. The annulus of between treatment injection string 112 and the walls (e.g., casing) of wellbore 114 is generally filled with a liquid (e.g., water or a working fluid). As described in greater detail below, the annulus pressure at the valves 126*a*, 126*b*, 126*c* (e.g., the pressure in the annulus at the surface combined with a hydrostatic pressure component) acts on the control valves 126*a*, 126*b*, 126*c* and maintains them in the open position. Thus, a loss in pressure in the annulus will cause the control valves 126*a*, 126*b*, 126*c* to close. The minimum pressure can be selected to allow for minor fluctuations in pressure to prevent accidental actuation of the control valves.

If the required surface pressure is removed, intentionally or unintentionally, the control valves 126*a*, 126*b*, 126*c* will automatically close, shutting off the flow of reactants and water downhole. In an emergency shut-down event, the surface annulus pressure source can be intentionally disconnected to disrupt reactant flow downhole. This particular embodiment requires no additional communication, power source etc. to be connected to the downhole valves in order for them to close.

Additionally, if hydrostatic pressure is lost, the control valves 126*a*, 126*b*, 126*c* will close thereby interrupting the flow of reactants downhole. Loss of working fluid from the annulus due to casing, supply tubing or packer leaks could cause this situation to occur.

A well head 117 may be disposed proximal to the surface 116. The well head 117 may be coupled to a casing 115 that extends a substantial portion of the length of the wellbore 114 from about the surface 116 towards the subterranean zone 110 (e.g., the subterranean interval being treated). The subterranean zone 110 can include part of a formation, a formation, or multiple formations. In some instances, the casing 115 may terminate at or above the subterranean zone 110 leaving the wellbore 114 un-cased through the subterranean zone 110 (i.e., open hole). In other instances, the casing 115 may extend through the subterranean zone and may include apertures 119 formed prior to installation of the casing 115 or by downhole perforating to allow fluid communication between the interior of the wellbore 114 and the subterranean zone. Some, all or none of the casing 115 may be affixed to the adjacent ground material with a cement jacket or the like. In some instances, the seal 122 or an associated device can grip and operate in supporting the downhole fluid heater 120. In other instances, an additional locating or pack-off device such as a liner hanger (not shown) can be provided to support the downhole fluid heater 120. In each instance, the downhole fluid heater 120 outputs heated fluid into the subterranean zone 110.

In the illustrated embodiment, wellbore 114 is a substantially vertical wellbore extending from ground surface 116 to subterranean zone 110. However, the systems and methods described herein can also be used with other wellbore configurations (e.g., slanted wellbores, horizontal wellbores, multilateral wellbores and other configurations).

The downhole fluid heater 120 is disposed in the wellbore 114 below the seal 122. The downhole fluid heater 120 may be a device adapted to receive and heat a treatment fluid. In one instance, the treatment fluid includes water and may be heated to generate steam. The recovery fluid can include other different fluids, in addition to or in lieu of water, and the treatment fluid need not be heated to a vapor state (e.g. steam) of 100% quality, or even to produce vapor. The downhole fluid heater 120 includes inputs to receive the treatment fluid and other fluids (e.g., air, fuel such as natural gas, or both) and may have one of a number of configurations to deliver heated treatment fluids to the subterranean zone 110. The downhole fluid heater 120 may use fluids, such as air and natural gas, in a combustion or catalyzing process to heat the treatment fluid (e.g., heat water into steam) that is applied to the subterranean zone 110. In some circumstances, the subterranean zone 110 may include high viscosity fluids, such as, for example, heavy oil deposits. The downhole fluid heater 120 may supply steam or another heated treatment fluid to the subterranean zone 110, which may penetrate into the subterranean zone 110, for example, through fractures and/or other porosity in the subterranean zone 110. The application of a heated treatment fluid to the subterranean zone 110 tends to reduce the viscosity of the fluids in the subterranean zone 110 and facilitate recovery to the surface 116.

In this embodiment, the downhole fluid heater is a steam generator 120. Supply lines 124*a*, 124*b*, 124*c* convey gas, water, and air to the steam generator 120. In certain embodiments, the supply lines 124*a*, 124*b*, 124*c* extend through seal 122. In the embodiment of FIG. 1, a surface based pump 142*a* pumps water from a supply such as a supply tank to piping 146 connected to wellhead 117 and water line 124*a*. Similarly oxidant and fuel are supplied from surface sources 142*b*, 142*c*. Various implementations of supply lines 124*a*, 124*b*, 124*c* are possible.

In some cases, a downhole fluid lift system (not shown), operable to lift fluids towards the ground surface 116, is at least partially disposed in the wellbore 114 and may be integrated into, coupled to or otherwise associated with a production tubing string (not shown). To accomplish this process of combining artificial lift systems with downhole fluid heaters, a downhole cooling system can be deployed for cooling the artificial lift system and other components of a completion system. Such systems are discussed in more detail, for example, in U.S. Pat. App. Pub. No. 2008/0083536 .

Supply lines 124*a*, 124*b*, 124*c* can be integral parts of the production tubing string (not shown), can be attached to the production tubing string, or can be separate lines run through wellbore annulus 128. Although depicted as three separate, parallel flow lines, one or more of supply lines 124*a*, 124*b*, 124*c* could be concentrically arranged within another and/or fewer or more than three supply lines could be provided. One exemplary tube system for use in delivery of fluids to a downhole fluid heater includes concentric tubes defining at least two annular passages that cooperate with the interior bore of a tube to communicate air, fuel and treatment fluid to the downhole heated fluid generator.

Figure 2A:
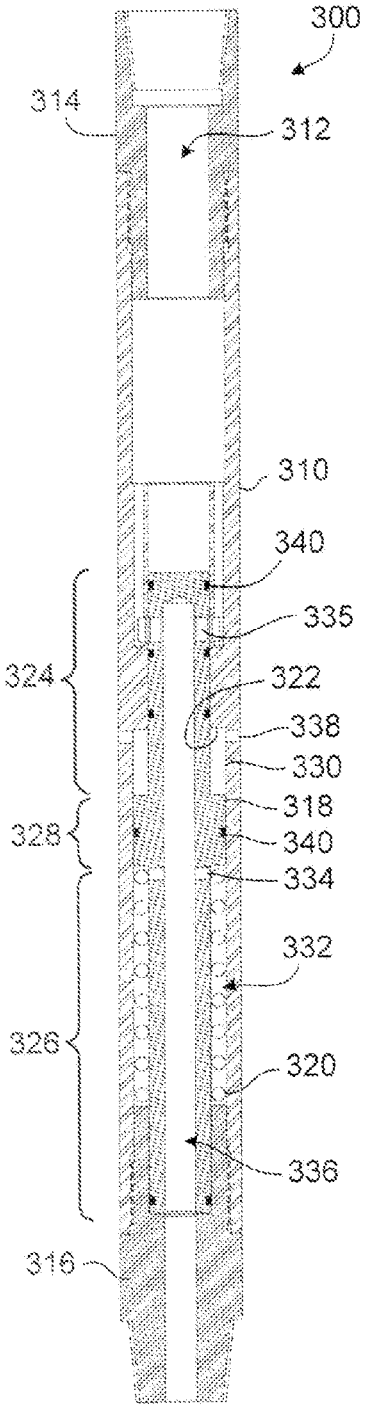
FIGS. 2A and 2B are cross-sectional views of an embodiment of a control valve for use in a system for treating a subterranean zone, such as that of FIG. 1, shown in open and closed positions, respectively.
Figure 2B:
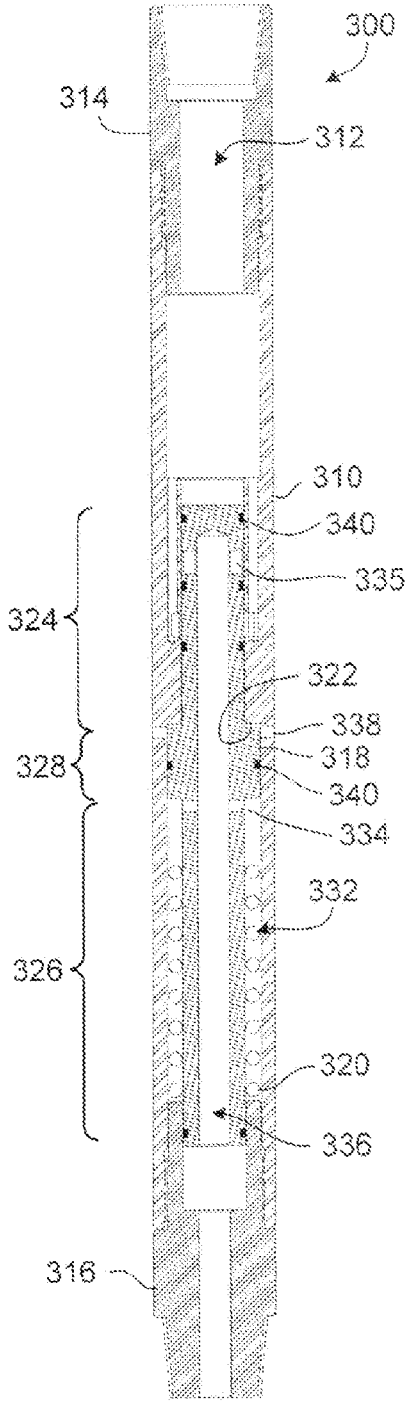

Referring to FIGS. 2A and 2B, an exemplary control (i.e., shutoff) valve 300 is shown in its open position (see FIG. 2A) and in its closed position (see FIG. 2B). The valve 300 has a substantially cylindrical body 310 defining a central bore 312. The valve body 310 includes ends with threaded interior surfaces which receive and engage an uphole connector 314 and a downhole connector 316. A moveable member 318 and a resilient member 320 (e.g., a spring, Bellville washers, a gas spring, and/or other—a coil spring is shown) are disposed within the central bore 312 between a shoulder 322 on the interior wall of valve body 310 and the downhole end of the valve body 310.

The moveable member 318 includes an uphole portion 324, a downhole portion 326, and a central portion 328 that has a larger maximum dimension (e.g., diameter) than the uphole portion 324 or the downhole portion 326. The uphole portion 324 of the moveable member 318 is received within and seals against interior surfaces of a narrow portion of the valve body 310 that extends uphole from shoulder 322. The downhole portion 326 of the moveable member 318 is received within and seals against interior surfaces of inner surfaces of downhole connector 316. The moveable member 318 and the valve body 310 together define an annular first cavity 330 on the uphole side of the central portion 328 of the moveable member 318 and an annular second cavity 332 on the downhole side of the central portion 328 of the moveable member 318.

Ports 334 extending through the moveable member 318 provide a hydraulic connection between an interior bore 336 of the moveable member 318 and the second cavity 332. Ports 338 extending through valve body 310 provide a hydraulic connection between the first cavity 330 and the region outside the valve body (e.g., a wellbore in which the valve 300 is disposed).

Ports 335 extending through the uphole portion 324 of the moveable member 318 provide a hydraulic connection between the interior bore 335 of the moveable member 318 and the interior bore 312 of valve body when the valve 300 is in its open position. In use, this hydraulic connection, allows fluids to flow through the valve 300. When the valve is in its closed position, ports 335 are aligned with a wall portion of the valve body and flow is substantially sealed against flowing through ports 335. Sealing members 340 (e.g., o-rings) are received in recesses in the outer surfaces of movable member 318 to sealingly engage the inner surfaces of valve body 310. Closure of the valve 300 substantially limits both uphole and downhole flow through the valve 300. For example, closure of the valve 300 in response to a casing rupture can limit (e.g., prevent) discharge of the reactants in the downhole supply lines 124*a*, 124*b*, 124*c* into the wellbore. In another example, closure of the valve 300 can limit (e.g., prevent) wellbore pressure from causing fluids to flow up the supply lines when annulus pressure is not present.

The net axial pressure forces from wellbore annulus pressure in the first cavity 330 bias the moveable member 318 in a downhole direction (i.e., toward the open position), and the net pressure forces from interior bore pressure in the second cavity bias the moveable member 318 in an uphole direction (i.e., toward the closed position). The resilient member 320 biases moveable member 318 in an uphole direction (i.e., towards the closed position). The area on which wellbore annulus pressure forces are acting on the moveable member 318 in first cavity 330, the area on which internal bore pressure forces are acting on the moveable member 318 in the second cavity 332, and the force exerted by the resilient member 320 on the moveable member 318 are selected to bias the moveable member 318 in a downhole direction (i.e., toward the open position) at a specified pressure differential between the wellbore annulus pressure and the internal bore pressure. In certain instances, the specified pressure differential can be selected based on normal operating conditions of the well system and downhole fluid heater 120, such that if the wellbore annulus pressure drops below normal operating conditions (i.e., a loss in wellbore pressure), the exemplary control valve 300 closes.

Figure 3:
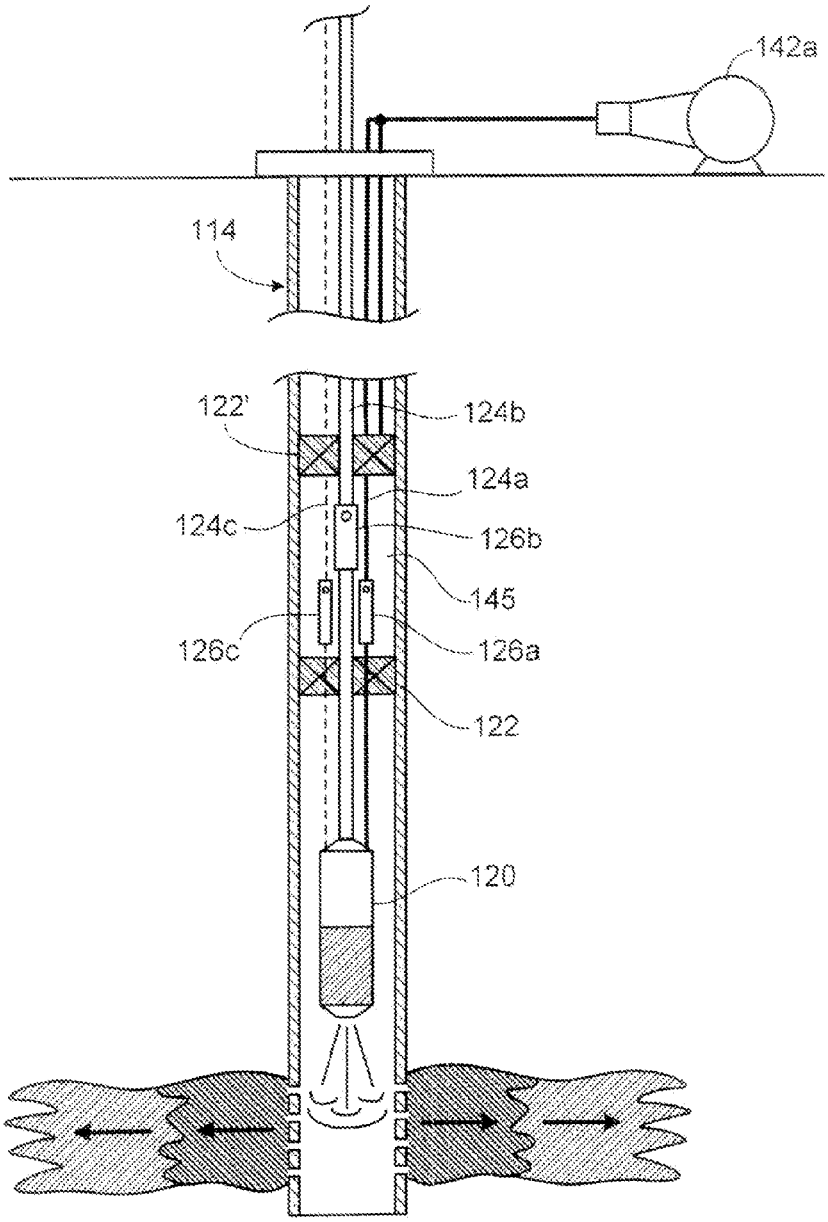
FIG. 3 is a schematic view of an embodiment of a system for treating a subterranean zone.

Referring to FIG. 3, another exemplary embodiment of the subterranean zone treatment system includes automatic control valves in the proximity of the downhole fluid heater which close in response to a loss of water supply pressure. It is desirable to have water flow to the downhole fluid heater/steam generator 120 when reactants (fuel and oxidant) are flowing to the fluid heater. Even a brief period in which combustion is taking place, but water flow has been interrupted, can cause severe damage or complete failure of the fluid heater, casing or other downhole components due to overheating.

Although generally similar to that discussed above with reference to FIG. 1, this embodiment includes seal 122 and upper seal 122'. Surface pump or other pressure supply 142*a* supplies treatment fluid through supply line 124*a*, control valve 126*a* and to the fluid heater 120 (e.g., steam generator). A branch from the supply line 124*a* is routed through upper packer or sealing device 122' into upper annulus 145 between seal 122 and upper seal 122'. In the illustrated embodiment, sealing device 122' is a packer. In some instances, the upper sealing device 122' may be the sealing device which is part of the tubing hanger which is fastened and sealed off at the wellhead flange. By providing a sealed interval between seal 122 and seal 122', the annulus pressure in the wellbore need not be solely the hydrostatic pressure of the fluid in the annulus 145 and can also include the pressure of fluid supplied by the pressure supply 142*a*. Should the pressure in the upper annulus 145 drop below a threshold value (e.g., a specified pressure) as a result of surface pump or pressure supply 142*a* failing to provide sufficient pressure for any reason, control valves 126*a*, 126*b*, 126*c* will automatically close. This embodiment can reduce the possibility that reactants can be introduced into the fluid heater without sufficient treatment fluid being present in the supply line 124*a*.

Figure 4:
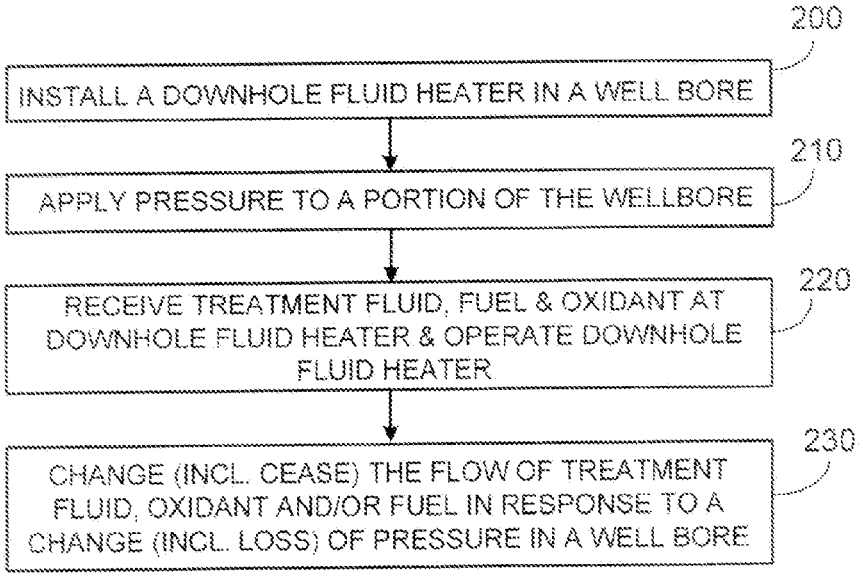
FIG. 4 is a flow chart of an embodiment of a method for operating a system for treating a subterranean zone.

Referring now to FIG. 4, in operation, wellbore 114 is drilled into subterranean zone 110, and wellbore 114 can be cased and completed as appropriate. After the wellbore 114 is completed, treatment injection string 112, downhole fluid heater 120, and seal 122 can be installed in the wellbore 114 with treatment fluid, oxidant, and fuel conduits 124*a*, 124*b*, 124*c* connecting fuel, oxidant and treatment sources 142*a*, 142*b*, 142*c* to the downhole fluid heater 120 (step 200). A seal 122 is then actuated to extend radially to press against and seal or substantially seal with the casing 115 to isolate the portion of the wellbore 114 containing the downhole fluid heater 120. Pressure is applied via a working fluid in a portion of the wellbore above the seal 122 to maintain open the control valves 126*a*, 126*b*, 126*c* on the fuel, oxidant and treatment fluid conduits 124*a*, 124*b*, 124*c* (step 210). In some cases, the pressure is applied in the form of hydrostatic pressure of the working fluid. In some instances, a second seal 122' is actuated to extend radially to press against and seal and/or substantially seal with the casing 115 and isolate a portion of the wellbore between seal 122 and 122'. A branch from the treatment fluid conduit 124*a* is hydraulically connected to the portion of the wellbore 114 between the first packer 122 and a second packer 122' to apply pressure above the seal 122.

The downhole fluid heater 120 can be activated, receiving treatment fluid, oxidant, and fuel to combust the oxidant and fuel, thus heating treatment fluid (e.g., steam) in the wellbore (step 220). The heated fluid can reduce the viscosity of fluids already present in the target subterranean zone 110 by increasing the temperature of such fluids and/or by acting as a solvent. After a sufficient reduction in viscosity has been achieved, fluids (e.g., oil) are produced from the subterranean zone 110 to the ground surface 116 through the production tubing string (not shown). In some instances, surface, wellbore or supply pressure integrity is lost due, for example, to system failure or the wellbore pressure is changed to change the flow of treatment fluid, oxidant and/or fuel (e.g., to change the ratio of oxidant and fuel). The loss of surface, wellbore or supply pressure integrity allows closure of the downhole safety valves and rapidly discontinue the flow of fuel, treatment fluid, and/or oxidant to the downhole fluid heater to provide failsafe downhole combustion or other power release (step 230).

A number of embodiments of the invention have been described. Nevertheless, it will be understood that various modifications may be made without departing from the spirit and scope of the invention.

For example, the system can be implemented with a variable flow treatment fluid control valve, variable oxidant fuel control valve and/or variable flow fuel control valve as supply control valves 126*a*, 126*b*, 126*c*. A variable flow control valve is a valve configured to change the amount of restriction through its internal bore in response to specified pressure conditions in the wellbore annulus. For example, the variable flow control valve may be responsive to cycling of pressure up and back down or down and back up in the wellbore annulus, responsive to a specified pressure differential between the valve's internal bore and the wellbore annulus, and/or responsive to other specified pressure conditions. In certain instances, the variable flow control valve can have a full open position (with the least internal restriction) a full closed position (ceasing or substantially ceasing against flow) and one or more intermediate positions of different restriction that can be cycled through in response to the specified pressure conditions.

In some instances, the variable flow control valves are adjusted remotely to change the reactant (fuel and oxidant) mixtures in response to specified pressure conditions in the wellbore annulus. For example, the variable flow control valves can be adjustable using wellbore annulus pressure cycling, pressure differential between the valve's internal bore and the wellbore annulus pressure, and/or other specified pressure conditions to adjust the flow restriction to the fuel inlet and/or the oxidant inlet remotely. In an embodiment using wellbore annulus pressure cycling, the variable flow control valves are adjusted to change the ratio of fuel to oxidant each time the annulus pressure is cycled in a specified manner (e.g., by momentarily raising or lowing the wellbore annulus pressure to a specified pressure). The ratio will remain at a particular setting after the last annulus pressure cycle is finished. A ratchet inside the valve causes incremental changes in the fuel/oxidant for each ratchet position, and the final ratchet position allows the ratio to return to an initial ratio. For example, the initial ratio may correspond to a minimum fuel/oxidant ratio, cycling the wellbore annulus pressure causes the valve to incrementally change ratchet positions and increase the fuel/oxidant ratio in one or more increments, and the final ratchet position returns the ratio from the maximum fuel/oxidant ratio to the minimum fuel/oxidant ratio. Subsequent applications of annulus pressure cycles will incrementally change the fuel oxidant ratio in incremental amounts until the maximum ratio is again reached and then reset back to the minimum ratio. In this way the ratio can be set to any desired level repeatedly. The ratchet technology described above is described in U.S. Pat. No. 4,429,748. Adjusting the fuel/oxidant ratio can be achieved by providing a variable flow fuel control valve as valve 126*c* and/or a variable flow oxidant control valve as valve 126*b*. Similar control of the treatment fluid can be achieved by providing a variable flow treatment fluid control valve as valve 126*a*.

In some embodiments, the fuel, oxidant and treatment fluid supply lines could have both shut off control valves and variable flow control valves, or both variable flow and shut-off positions and control could be incorporated into the same valves. Using a combination of the features of the exemplary embodiments described above and illustrated in Figures primary and secondary valve operation assures safe and effective operation of the downhole combustion and steam generation system under a wide variety of potential downhole and surface conditions.

Accordingly, other embodiments are within the scope of the following claims.

What is claimed is:

1. A system for installation in a wellbore, comprising:

a downhole fluid heater in a downhole treatment string, the downhole fluid heater having a treatment fluid inlet, an oxidant inlet and a fuel inlet;

a downhole control valve actuable using fluid pressure in an annulus between the downhole treatment string and a wall of the wellbore, the fluid pressure in the annulus acting on the downhole control valve and residing in communication with one of the treatment fluid inlet, oxidant inlet or fuel inlet of the downhole fluid heater, the downhole control valve responsive to cease flow to the inlet based on a loss of the fluid pressure in the annulus between the wellbore and the downhole treatment string;

a first seal disposed between the downhole fluid heater and the downhole control valve, the first seal adapted to contact the wall of the wellbore and hydraulically isolate a portion of the wellbore above the first seal from a portion of the wellbore below the first seal;

a second seal disposed between a well head of the wellbore and the first seal and opposite the downhole control valve from the first seal, the second seal adapted to contact the wall of the wellbore and hydraulically isolate a portion of the wellbore above the second seal from a portion of the wellbore below the second seal; and a conduit in communication with a space between the first seal and the second seal and adapted to provide additional pressure to the annulus of the wellbore between the first seal and the second seal.

2. The system of claim 1, wherein the conduit is in communication with a treatment fluid supply adapted to provide treatment fluid to the downhole fluid heater.

3. The system of claim 2, wherein the conduit is routed from the treatment fluid supply through the second seal into the space between the first seal and the second seal.

4. The system of claim 1, wherein the downhole control valve further comprises a moveable member movable to change the flow to the inlet at least in part by a pressure differential between the flow to the inlet and pressure in the wellbore.

5. The system of claim 1, wherein the downhole control valve is in communication with the fuel inlet; and wherein the system further comprises a second downhole control valve in communication with one of the treatment fluid inlet or oxidant inlet of the downhole fluid heater.

6. The system of claim 1, wherein the downhole control valve is proximate the downhole fluid heater.

7. The system of claim 1, wherein the downhole fluid heater comprises a downhole steam generator.

8. A system for treating a subterranean zone, comprising:

a downhole fluid heater of a treatment injection string installed in a wellbore;

treatment fluid, oxidant, and fuel conduits connecting fuel, oxidant and treatment fluid sources to the downhole fluid heater;

a downhole fuel control valve actuable using fluid pressure fluid pressure in an annulus between the treatment injection string and a wall of the wellbore, the fluid pressure in the annulus acting on the downhole fuel control valve and residing in communication with the fuel conduit, the downhole fuel control valve configured to cease flow to the downhole fluid heater in response to a loss of the fluid pressure in a portion of the annulus between the wall of the wellbore and the treatment injection string;

a first seal disposed between the downhole fluid heater and the downhole fuel control valve, the seal sealing against axial flow in the wellbore, and wherein the downhole fuel control valve is configured to change flow to the downhole fluid heater in response to a loss of the fluid pressure in the annulus above the seal; and a second seal disposed between a well head of the wellbore and the first seal and uphole of the downhole fuel control valve, the second seal sealing against axial flow in the wellbore, and wherein the treatment fluid conduit is hydraulically connected to a portion of the wellbore defined in part between the first seal and the second seal.

9. The system of claim 8, wherein the downhole fuel control valve comprises a moveable member movable at least in part by pressure in the wellbore to change flow through the fuel conduit.

10. The system of claim 8, further comprising a second downhole control valve in communication with the treatment fluid or the oxidant conduit and responsive to pressure in the portion-of the wellbore.

11. The system of claim 8, wherein the downhole fluid heater comprises a downhole steam generator.

12. The system of claim 8, wherein a branch from the treatment fluid conduit is routed through the second seal into the portion of the wellbore defined in part between the first seal and the second seal.

13. A method of treating a subterranean zone, comprising:

after a wellbore is completed, installing a treatment injection string, a downhole fluid heater, a first seal and a second heal in the wellbore with fuel, oxidant and treatment fluid conduits connecting fuel, oxidant and treatment sources to the downhole fluid heater;

actuating the first seal to extend radially to press against and seal or substantially seal with a casing to isolate a portion of the wellbore containing the downhole fluid heater, wherein the first seal is disposed between the downhole fluid heater and downhole control valves for the fuel, oxidant and treatment fluid conduits, the first seal adapted to contact a wall of the wellbore and hydraulically isolate a portion of the wellbore above the first seal from a portion of the wellbore below the first seal;

applying pressure via a working fluid in a portion of the wellbore above the first seal to maintain open the downhole control valves on the fuel, oxidant and treatment fluid conduits;

actuating the second seal to extend radially to press against and seal or substantially seal with the casing to isolate a portion of the wellbore between the first seal and the second seal, wherein the second seal is disposed between a well head of the wellbore and the first seal and opposite the downhole control valves from the first seal, the second seal adapted to contact the wall of the wellbore and hydraulically isolate a portion of the wellbore above the second seal from a portion of the wellbore below the second seal, and a branch from the treatment fluid conduit is hydraulically connected to the portion of the wellbore between the first seal and the second seal to apply additional pressure above the first seal;

receiving, at the downhole fluid heater in the wellbore, flows of the treatment fluid, oxidant, and fuel; and with the downhole control valves, actuable using annulus pressure acting on the downhole control valves and responsive to the annulus pressure, ceasing the flow of at least one of the treatment fluid, oxidant or fuel in response to a loss of pressure in the wellbore annulus external to the downhole fluid heater.

14. The method of claim 13, further comprising applying pressure to a portion of the wellbore proximate the downhole control valve, and wherein ceasing the flow comprises ceasing the flow in response to the loss of pressure in the wellbore proximate the downhole control valve.

15. The method of claim 13, further comprising changing the flow of at least one of the oxidant or the fuel to change a ratio of oxidant to fuel supplied to the downhole fluid heater.

16. The method of claim 13, wherein the downhole fluid heater comprises a downhole steam generator.

17. The method of claim 13, wherein the branch is routed through the second seal into the portion of the wellbore between the first seal and the second seal.

18. A system for installation in a wellbore, comprising:

a downhole fluid heater having a treatment fluid inlet, an oxidant inlet and a fuel inlet;

a first downhole control valve actuable using annulus pressure acting on the downhole control valve and residing in communication with one of the treatment fluid inlet, oxidant inlet or fuel inlet of the downhole fluid heater, the first downhole control valve responsive to cease flow to the inlet based on a loss of pressure in the wellbore external to the downhole fluid heater, the first downhole control valve in communication with the fuel inlet;

a second downhole control valve in communication with one of the treatment fluid inlet or oxidant inlet of the downhole fluid heater;

a first seal disposed between the downhole fluid heater and the downhole control valve, the first seal adapted to contact a wall of the wellbore and hydraulically isolate a portion of the wellbore above the first seal from a portion of the wellbore below the first seal;

a second seal disposed between a well head of the wellbore and the first seal and opposite the downhole control valve from the first seal, the second seal adapted to contact the wall of the wellbore and hydraulically isolate a portion of the wellbore above the second seal from a portion of the wellbore below the second seal; and a conduit in communication with a space between the first seal and the second seal and adapted to provide additional pressure to the wellbore between the first seal and the second seal.

19. A system for treating a subterranean zone, comprising:

a downhole fluid heater installed in a wellbore;

treatment fluid, oxidant, and fuel conduits connecting fuel, oxidant and treatment fluid sources to the downhole fluid heater;

a first downhole fuel control valve actuable using annulus pressure acting on the first downhole fuel control valve and residing in communication with the fuel conduit, the first downhole fuel control valve configured to cease flow to the downhole fluid heater in response to a loss of pressure in a portion of the wellbore external to the downhole fluid heater;

a second downhole control valve in communication with the treatment fluid or the oxidant conduit and responsive to pressure in the portion of the wellbore;

a first seal disposed between the downhole fluid heater and the downhole fuel control valve, the seal sealing against axial flow in the wellbore, and wherein the downhole fuel control valve is configured to change flow to the downhole fluid heater in response to a loss of pressure above the seal; and a second seal disposed between a well head of the wellbore and the first seal and uphole of the downhole fuel control valve, the second seal sealing against axial flow in the wellbore, and wherein the treatment fluid conduit is hydraulically connected to a portion of the wellbore defined in part between the first seal and the second seal.

20. A system for installation in a wellbore, comprising:

a downhole fluid heater having a treatment fluid inlet, an oxidant inlet and a fuel inlet;

a downhole control valve actuable using annulus pressure acting on the downhole control valve and residing in communication with one of the treatment fluid inlet, oxidant inlet or fuel inlet of the downhole fluid heater, the downhole control valve responsive to cease flow to the inlet based on a loss of pressure in the wellbore external to the downhole fluid heater;

a first seal disposed between the downhole fluid heater and the downhole control valve, the first seal adapted to contact a wall of the wellbore and hydraulically isolate a portion of the wellbore above the first seal from a portion of the wellbore below the first seal;

a second seal disposed between a well head of the wellbore and the first seal and opposite the downhole control valve from the first seal, the second seal adapted to contact the wall of the wellbore and hydraulically isolate a portion of the wellbore above the second seal from a portion of the wellbore below the second seal; and a conduit in communication with a space between the first seal and the second seal and adapted to provide additional pressure to the wellbore between the first seal and the second seal, where the pressure external to the downhole fluid heater comprises a pressure in an annulus between a surface of the wellbore and a treatment injection string adapted to communicate fluids from a terranean surface to a subterranean zone.

* * * * *

UNITED STATES PATENT AND TRADEMARK OFFICE

CERTIFICATE OF CORRECTION

PATENT NO. : 9,133,697 B2
APPLICATION NO. : 12/667988
DATED : September 15, 2015
INVENTOR(S) : Travis Wayne Cavender and Roger L. Schultz It is certified that error appears in the above-identified patent and that said Letters Patent is hereby corrected as shown below:

On the title page, under Abstract, line 5, replace "142band" with -- 142b, and --

Claims

Column 11, line 8, claim 8, before "in", delete "fluid pressure"

Column 11, line 35, claim 10, replace "portion-of" with -- portion of --

Column 11, line 45, claim 13, replace "heal" with -- seal --

Signed and Sealed this
Eighth Day of March, 2016

Michelle K. Lee

Michelle K. Lee
*Director of the United States Patent and Trademark Office*